US005261208A

United States Patent [19]

Lockhart

[11] Patent Number: 5,261,208

[45] Date of Patent: Nov. 16, 1993

[54] TAMPER-PROOF CARTON AND METHOD FOR USING SAME IN RETAILING FOOD AND DRUG PRODUCTS

[76] Inventor: Walter R. Lockhart, 938B Fontmore Rd., Colorado Springs, Colo. 80904

[21] Appl. No.: 958,945

[22] Filed: Oct. 9, 1992

[51] Int. Cl.[5] ..... B65B 21/08; B65D 75/00

[52] U.S. Cl. ..... 53/398; 53/467; 53/475; 206/427; 220/507; 220/509; 221/69; 221/89

[58] Field of Search ..... 53/398, 410, 444, 453, 53/467, 472, 475, 262, 48.1; 220/507, 509, 513, 516, 518; 206/427, 429, 206; 221/87, 89, 69, 125

[56] References Cited

U.S. PATENT DOCUMENTS

| | | | |
|---|---|---|---|
| 734,856 | 7/1903 | Hahn | 206/427 X |
| 1,025,909 | 5/1912 | Forsyth . | |
| 1,125,781 | 1/1915 | Waldman | 220/509 X |
| 1,297,205 | 3/1919 | McLaren . | |
| 1,741,474 | 12/1929 | Moore . | |
| 1,858,198 | 5/1932 | Georg et al. . | |
| 1,964,335 | 6/1934 | Wessman . | |
| 2,091,603 | 8/1937 | Lemire | 221/89 X |
| 2,105,517 | 1/1938 | Auslander | 221/89 X |
| 2,199,242 | 4/1940 | Ladd | 221/87 |
| 2,706,066 | 4/1955 | Wells . | |
| 3,097,765 | 7/1963 | Newton . | |
| 3,119,521 | 1/1964 | Taylor . | |
| 3,165,234 | 1/1965 | Conklin et al. . | |
| 3,409,177 | 11/1968 | Tschudy . | |
| 3,486,658 | 12/1969 | Cheslak et al. . | |
| 3,895,713 | 7/1975 | Bunnell | 206/427 |
| 3,973,687 | 8/1976 | Glick . | |
| 4,511,052 | 4/1985 | Klein et al. . | |
| 4,579,250 | 4/1986 | Fuss et al. . | |
| 4,671,405 | 6/1987 | Hagan | 220/507 X |
| 4,798,310 | 1/1989 | Kasai et al. | 221/87 |
| 4,817,818 | 4/1989 | Lockhart . | |
| 4,890,765 | 1/1990 | Haber et al. | 221/89 X |
| 5,127,210 | 7/1992 | Jensen | 53/475 X |
| 5,215,208 | 6/1993 | Jackson | 220/509 X |

FOREIGN PATENT DOCUMENTS

| | | | |
|---|---|---|---|
| 2223764 | 3/1973 | France . | |
| 412075 | 2/1993 | U.S.S.R. | 220/509 |

*Primary Examiner*—Horace M. Culver
*Attorney, Agent, or Firm*—Gary M. Polumbus

[57] ABSTRACT

The present invention involves a tamper-proof apparatus and method for assuring the integrity of containers of consumer goods. A special carton, which becomes part of the retail display, has a plurality of controlled dispensing openings such that once a container has been removed, it cannot be replaced in the carton. Accordingly, a container cannot be removed from the carton, its contents altered, and the container replaced in the carton to be purchased by an unwitting consumer. Several alternative systems are employed for assembling the carton in a secure, tamper-proof manner. Further, if the carton is loaded at the point of manufacture or distribution, once the carton is loaded, the carton is sealed to provide indicia of potential tampering between the point of manufacture or distribution and the ultimate point of sale at a retail location.

22 Claims, 5 Drawing Sheets

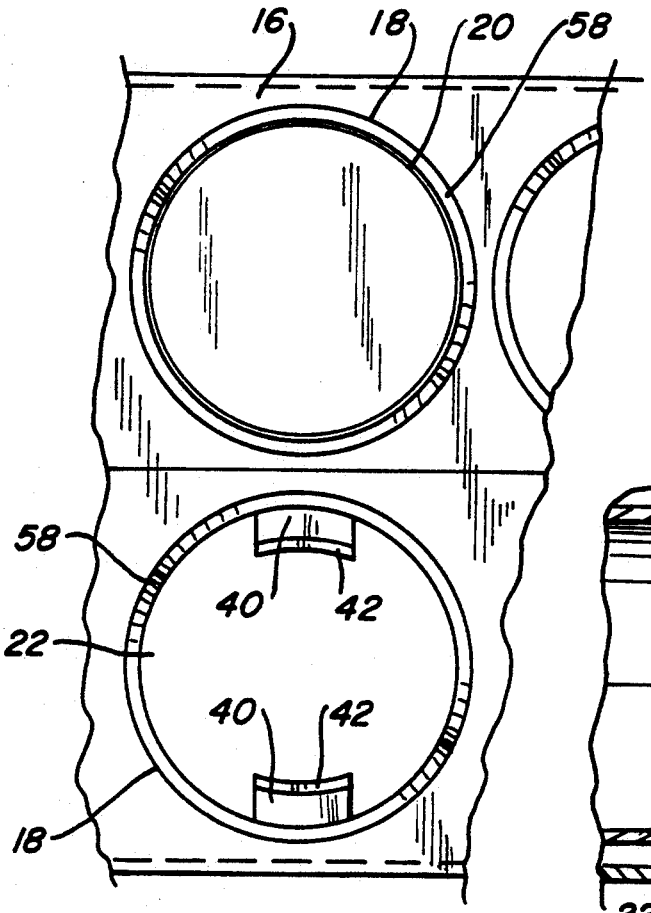
Fig_4
Fig_5
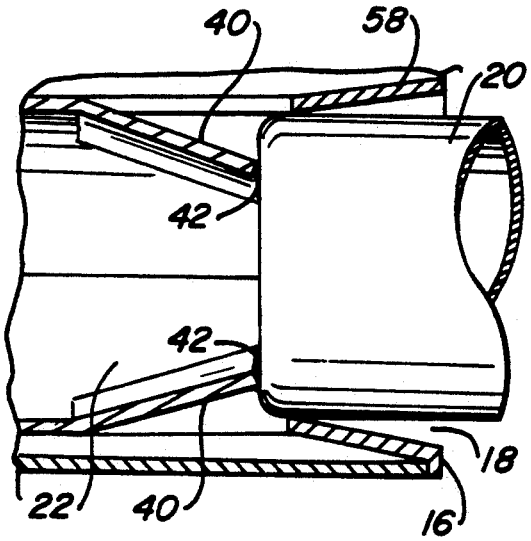
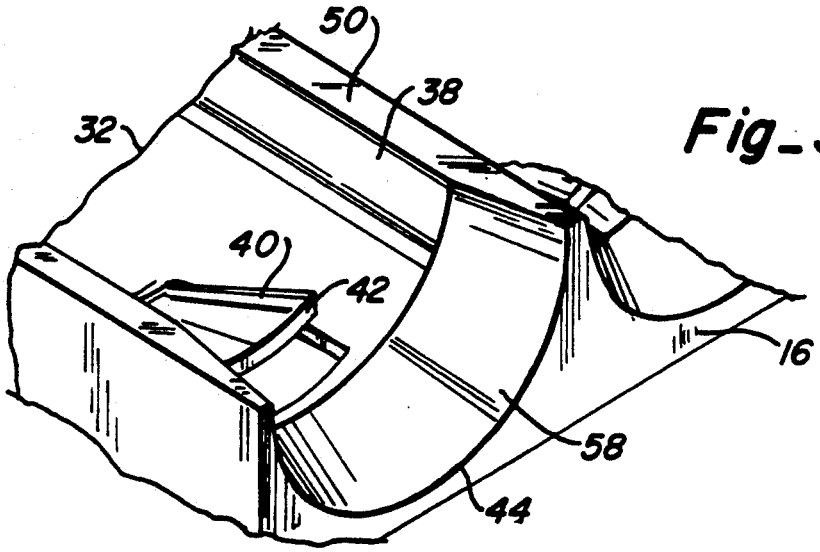
Fig_3

TAMPER-PROOF CARTON AND METHOD FOR USING SAME IN RETAILING FOOD AND DRUG PRODUCTS

BACKGROUND OF THE INVENTION

1. Field of the Invention

The present invention relates generally to the distribution and retail sales of products for human consumption such as food and drug products and, more particularly, to a tamper-proof carton for distributing and selling such products and the method of using the same in retail sales.

2. Description of the Prior Art

For many years, food and drug products have been distributed and sold in containers which could be easily opened and closed without detection by sales personnel or consumers. As a result of the distribution and sales of such products in containers whose integrity could not be assured, food and drug products in recent years have been tampered with at various stages in the manufacturing, distribution, and/or sales process. On occasion, this tampering included poisonous substances being introduced into the products, resulting in poisoning and, tragically, death of the consumers of the products.

In an effort to preclude such tampering, bottles, jars, and other containers are now being sealed by most companies to discourage tampering. This is done usually by providing closures and seals for the containers which evidence tampering with the closure. In this manner, a consumer theoretically should be able to discern whether a container which he/she may be purchasing has been tampered with, and, therefore, be warned that a particular item should not be purchased or consumed.

Unfortunately, however, ways have been found to tamper with products which employ these supposedly sealed, tamper-resistant containers. For example, lethal substances may be injected into such a container with a hypodermic needle in a manner which is difficult for a typical consumer to detect. Similarly, a container may be removed from a retail display, the contents altered, and the container resealed and replaced in the retail display all in such a manner that upon ordinary inspection a consumer would not be aware of the tampering. Consequently, conventional tamper-resistant seals will not always protect a consumer from possible tampering.

Accordingly, while many attempts have been made to design tamper-proof containers to protect against poisoning or other contamination of the products contained therein, these attempts have not been totally successful. The risk of tampering and contamination of food and drug products continues to pose a serious problem.

SUMMARY OF THE INVENTION

The present invention relates to a tamper-proof carton for distributing and selling products for human consumption as well as to a method of using the same. In accordance with the invention, product integrity does not depend solely upon individual tamper-proof seals being placed on product containers, but rather depends upon the collective packaging and display of containers of consumer products in tamper-proof cartons. The system and method of the present invention comprises the fabrication and use of a tamper-proof carton, shipped pre-loaded and pre-assembled from the point of manufacture or distribution to the point of purchase by a consumer, as well as the fabrication and use of a tamper-proof carton which can be refilled, reassembled and reused at the retail location which is tamper-proof at the point of purchase.

In one embodiment, the system and method of the present invention comprises the fabrication and use of a tamper-proof carton that is shipped from the point of manufacture or distribution in a pre-loaded and pre-assembled condition to the point of purchase. In this embodiment, once a tamper-proof carton is loaded with containers of consumer product at the point of manufacture or distribution, the carton is durably assembled so that the containers of consumer product in the carton cannot be removed and replaced. During transport from the point of manufacture to the retail sales location, dispensing openings in the carton may each be fitted with a removable, non-resealable closure, or the carton may be enveloped in its entirety with a seal. Accordingly, if a carton arrives at a retail destination and the sealing has been tampered with, it will be readily apparent to the persons involved in the sales process and the products in that carton would not be sold. On the other hand, once a carton which has not been tampered with has reached a retail sales destination, the carton is placed on a shelf, the seals are removed, and the product is made available to consumers.

In other embodiments of the invention, the tamper-proof carton is designed to receive the containers of consumer product, but the carton is not necessarily shipped pre-loaded and pre-assembled from the point of manufacture or distribution. Rather, the carton can be loaded and assembled at the retail location. Instead of durably assembling the carton, locking closure means are provided to seal the container after loading or reloading.

In further accordance with the present invention, unlike the shipping cartons used in conventional distribution methods, the shipping carton used in the present invention is not discarded and represents an integral part of the actual sales process. Cartons in accordance with the invention can be arranged on retail shelves or similar displays and include one or more openings for dispensing product containers. Of particular interest is that the dispensing of the containers is controlled such that once a container has been removed from the carton it cannot be reinserted or replaced in the carton. Consequently, an individual container cannot be removed, tampered with and then replaced in the dispensing carton. As a result, consumers are assured that any products they remove from a carton will not have been tampered with, and they are told not to purchase products which have been previously removed from the carton and left loose in retail space.

Necessarily, this invention entails a different procedure for retail sales in that the containers of product would not be exposed on a shelf as in current retailing systems. One must note, however, that the cartons of the present invention provide additional surfaces on which suitable advertising for the product contained therein may be displayed. Accordingly, consumers are well-apprised of the product which he/she wishes to purchase as well as assured that the product has not been tampered. This assurance of product integrity is not possible, or at least has not been achieved, with current distribution and sales cartons and techniques.

Other aspects, features, and details of the present invention can be more completely understood by reference to the following detailed description of a preferred embodiment, taken in conjunction with the drawings and from the appended claims.

BRIEF DESCRIPTION OF THE DRAWINGS

FIG. 3 is a fragmentary isometric view illustrating a portion of a recess in a section of a carton showing a flexible tongue in the recess.

FIG. 4 is a fragmentary front elevation of the carton shown in FIG. 1.

FIG. 5 is a fragmentary vertical section take through a compartment of a carton with a product container partially removed therefrom.

DETAILED DESCRIPTION OF THE PREFERRED EMBODIMENT

The broad premise of the present invention is to package containers of consumer goods in a secured carton such that a container cannot be replaced in the carton once the container has been removed from the carton. Consequently, one cannot remove a container of consumer product from the tamper-proof carton, alter its contents and replace the container in the carton where it might be purchased by an unwary consumer.

In a first preferred embodiment of the invention, the invention generally protects the integrity of consumer product in two stages. First, after containers of consumer product are loaded into cartons at the point of manufacturing or distribution and the carton is durably assembled, the carton is fitted with seals. Consequently, if upon arrival at the retail site, retail personnel discern that the integrity of a carton seal has been breached, the retail personnel know that this carton is not to be sold because the contents of the carton may have been tampered with. If the seals are intact, the retail personnel know that the contents of the carton have not been tampered with since shipment from the packaging location, and the retail personnel remove the seals from the carton so that the contents of the carton can be accessed by consumers.

Second, to prevent the risk of tampering with the contents of the containers of consumer product after the containers have been placed on sale at the retail site, the carton is specially designed such that once containers of product are removed from the carton they cannot be replaced in the carton. Accordingly, the containers cannot be removed from the cartons at the retail site, tampered with and replaced in the carton. Thus, consumers are assured that if they personally remove a container from the specially designed carton, the integrity of the contents of that container has not been breached. On the other hand, consumers know that they should not purchase containers which already have been removed from the carton because the contents of the carton may have been tampered with at the retail location.

Figure 1:
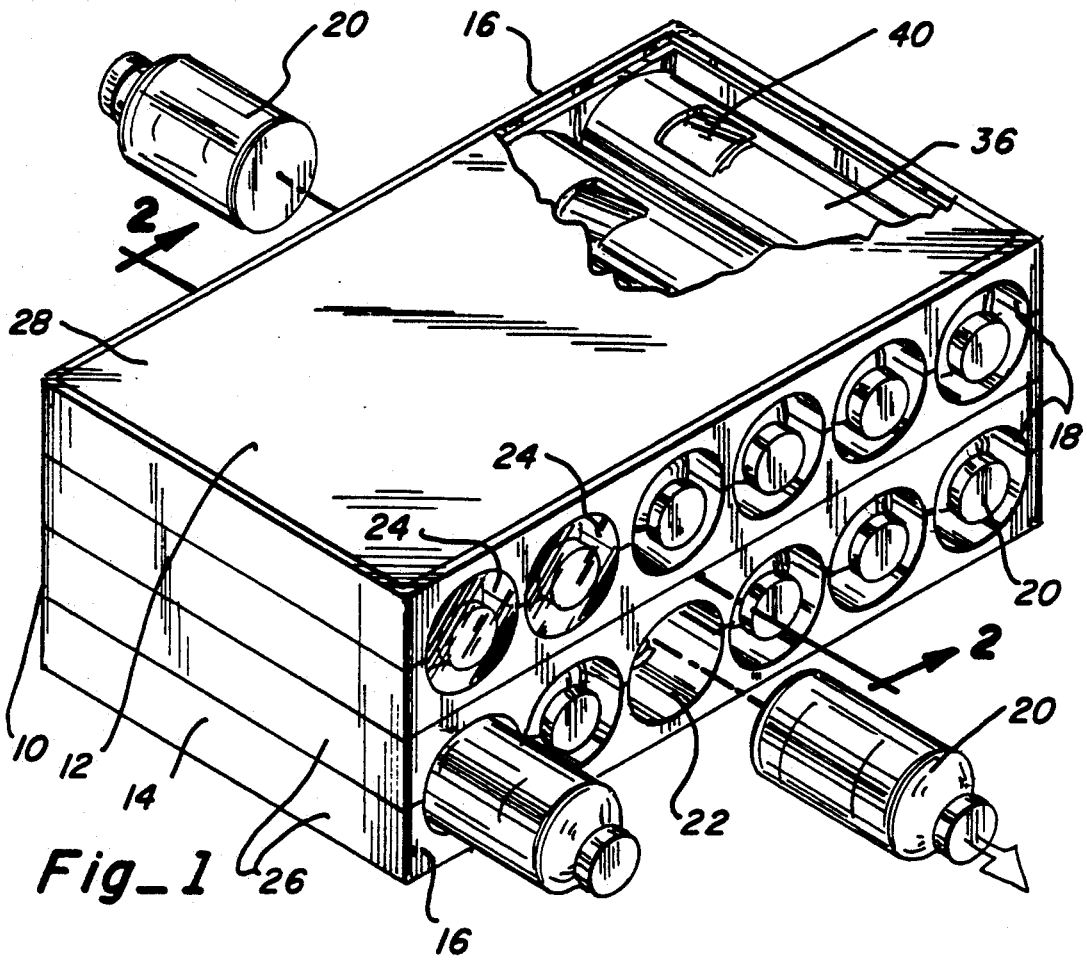
FIG. 1 is an isometric view of the carton of the present invention with parts broken away for clarity.

The carton 10 of the first embodiment of the present invention, shown in FIG. 1, has rectangular top and bottom surfaces 12, end surfaces 14 and front and back faces 16. The front and back faces present a number of openings 18 through which containers of consumer product 20 are dispensed from cylindrical compartments 22. These openings are covered at the manufacturing or distribution site with seals 24.

A number of known methods could be used for sealing the cartons 10 at the packaging site for ensuring the integrity of the carton in shipment. Foil, paper or plastic seals 24 could be affixed over the openings 18, similar to those used as inner seals on jars of many consumer food and drug products, so that tampering would be readily apparent to retail personnel stocking the shelves with the cartons. Similarly, specially printed foil, paper or plastic wraps (not shown) could be used to cover the entire carton, including the openings therein, such that any tampering would be evident. If on arrival at a retail location, the integrity of the seals have been breached, it is possible that the contents have been tampered with and the merchandise will not be sold. Accordingly, the seals provide indicia of the integrity of the contents of containers of consumer products between the packaging site and the retail location.

The carton 10 is formed of complementary confronting sections 26 which are fastened together to form layers of the carton. A plurality of these sections may be attached in confronting relationship to form a multi-layered carton as shown in FIG. 1. End pieces 28 are fastened to the top and bottom walls of the uppermost and lowermost sections, respectively, to close the carton.

Figure 6:
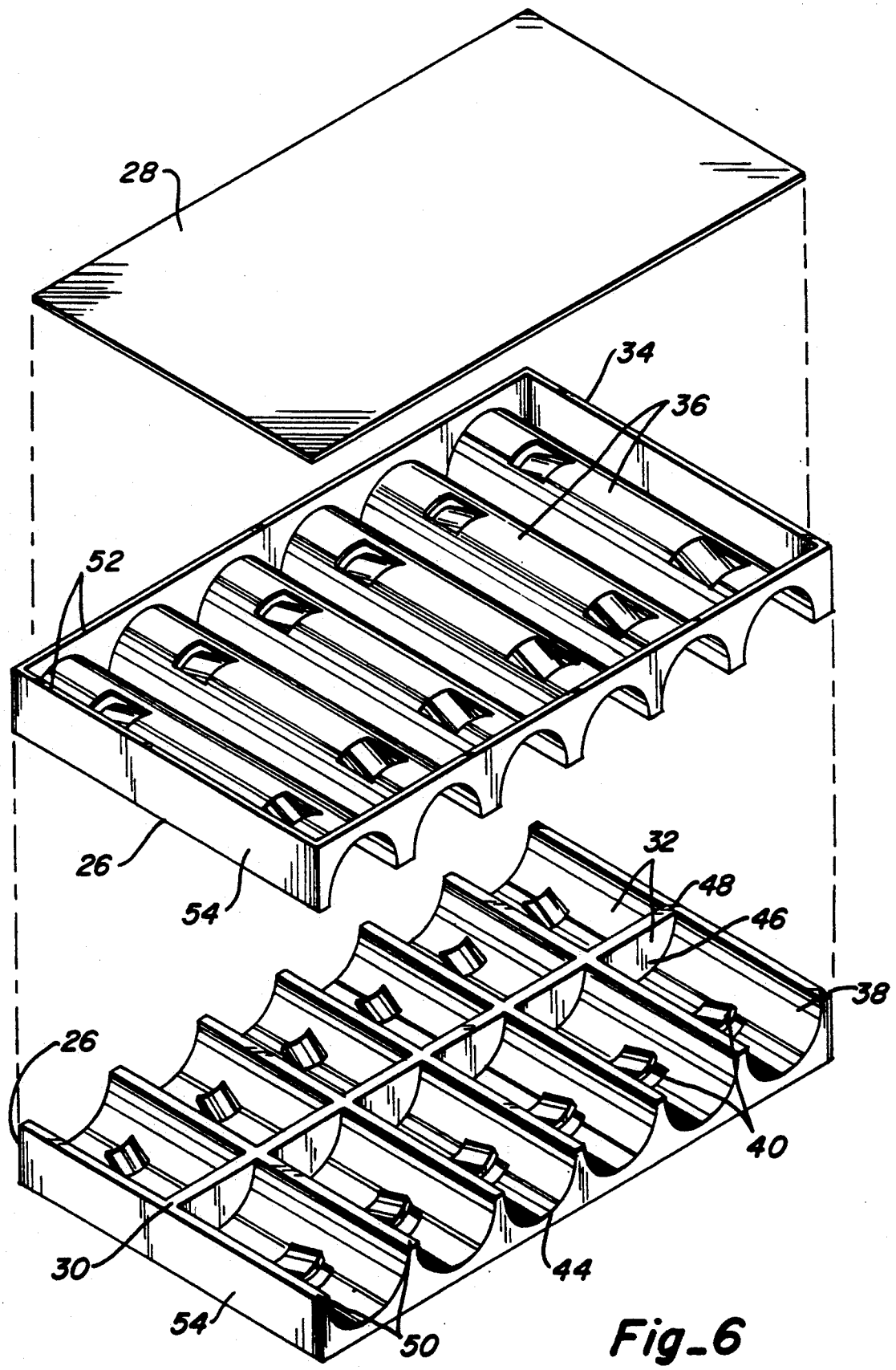
FIG. 6 is an exploded isometric view illustrating the components of the carton of the present invention.

The sections 26 of the carton 10, as best seen in FIG. 6, have a rectangular footprint and are, generally, hollow. In a confronting face 30 of the section, two rows of equally-shaped, semi-cylindrical hollow recesses 32 are formed which, on the non-confronting face 34 form convex, semi-cylindrical walls 36. Approximately centrally located in the inner walls of the hollow recesses 38 are dispensing control mechanisms in the form of flexible tongues or fingers 40 having a detached end 42 facing the open ends of the recesses 44, the tongues protruding into the semi-cylindrical hollow recesses. The tongues are formed in the sections 26 at the time the sections are fabricated. Further, in the confronting face is formed a transverse dividing wall 46 separating the semi-cylindrical recesses into halves. The exposed edge of the transverse dividing wall 48, as well as the exposed surfaces of the walls bounding the semi-cylindrical recesses 50, are flat, facilitating the joining of the sections in a confronting relationship as will become more clear later.

The outermost peripheral edges 52 of the non-confronting faces of the section 26 are also flat, facilitating the joining of additional sections or the joining of end pieces 28 to the section. The end pieces, which maintain the integrity of the carton, are also smooth to provide a more finished appearance to the carton 10. The exposed opposite end surfaces 54 of the section are also smooth to present a finished appearance. The end surfaces of the sections 54, which collectively comprise the end surfaces of the carton 14, as well as the end pieces 28, may be decorated with product identification or other advertising information to enhance the appearance of the carton.

A close-up detail of a semi-cylindrical recess 32 formed in the sections 26 of the carton 10 is shown in FIG. 3. The flexible tongue 40 formed in the semi-cylindrical surface 38 of the recess is shown in a normal position 56 protruding into the semi-cylindrical recess. Also shown is a flared or frusto-conical wall 58 defining a removal port or dispensing opening 18 in the face 16 of the carton. It will be further appreciated that this wall presents a slightly larger portal for grasping and removing a container of product from the carton without breaching the integrity of the carton as will be detailed below.

The sections 26 of the carton 10 can be made from a number of different suitable materials. In the preferred embodiment, however, the sections of the carton are molded of plastic. Molding the sections from plastic can be accomplished in a single step.

The carton 10 can be assembled from the sections 26 and end pieces 28 in a number of ways. For example, using plastic materials, the sections can be glued together or sonically welded to form each individual layer and to join adjacent layers of the carton. Similarly, if made of plastic, the end pieces can be either glued or sonically welded to the uppermost and lowermost sections of the container. In the preferred embodiment, to ensure the integrity of the containers, the containers are loaded into the sections 26 before they are joined to form the layers of the carton, for reasons which will be appreciated after further description of the carton.

Figure 2:
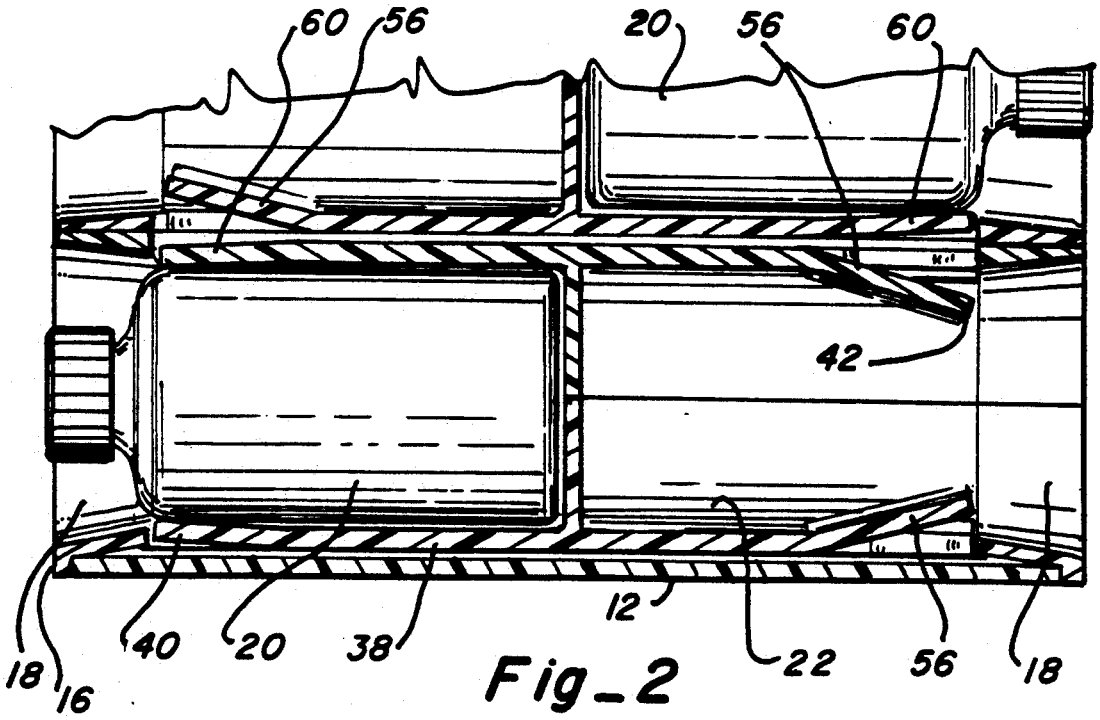
FIG. 2 is an enlarged fragmentary section taken along line 2—2 of FIG. 1.

The cylindrical compartments 20, in conjunction with the flexible tongues 40 whose detached ends 42 face the openings 18 in the compartments, ensure the integrity of containers of consumer product 20. As shown in FIG. 2, the containers fit securely within the cylindrical compartments 22 which have a cross-sectional area only slightly greater than that of the container. The containers of product are further frictionally secured by the flexible tongues 40. As best shown in FIG. 2, in their normal positions 56, the tongues protrude into the space of the cylindrical compartments. However, when a container is present in the cylindrical compartment, the container displaces or flexes the tongues to a retracted, stressed position 60. The tongues press against the sides of the containers, thereby frictionally securing the containers in place within the cylindrical compartments.

In addition to securing the containers 20 in place in the cylindrical compartments 22, the flexible tongues 40 prevent containers from being reinserted in the cylindrical compartments 22 once the containers have been removed. Again, once the containers have been removed from the cylindrical compartments, the tongues return to their normal positions 56, protruding into the cylindrical compartments as shown in FIGS. 2 and 5. Accordingly, if one were to attempt to reinsert a container into one of the cylindrical compartments, the container would contact the detached ends 42 of the associated tongues, and the container would be blocked from being inserted back into the cylindrical compartment. As a result of the system of the present invention, consumers seeing containers positioned within the carton would be assured that those containers had not been previously removed from the carton at the retail site and possibly tampered with.

In order to perform optimally, a few considerations must be observed. First, the tongues 40 should be recessed within the cylindrical compartments 22 such that the tongues could not be manipulated into their retracted positions 58 with an individual's fingers or a tool while one attempts to reinsert a container 20 into the cylindrical compartments. Second, for the same reason, to prevent the tongues from being displaced by a tool allowing reinsertion of the containers, the cylindrical compartments should be relatively closely fitted to the size of the containers. If there is a close fit between the containers and the sides of the cylindrical compartments, there will be no room to insert a tool to manipulate the tongues. Third while the tongues should be recessed, they should not be recessed very far into the cylinder. Specifically, the tongue should be close enough to the dispensing opening 18 that if one attempted to replace a container in the opening, its center of gravity would not be able to pass within the face 16 of the carton. As a result, one not only would not be able to insert the container back into the cylindrical compartment, but also would not be able to rest the container within the opening short of the tongues, for the container would simply fall out of the opening.

As can be appreciated from the preceding description of the carton, the sections 26 should be loaded with containers of consumer product 20 before the sections are joined to form the carton 10. This simplifies loading because, as previously detailed, the tongues 40 prevent the containers from being inserted into the compartments 22 in the carton.

Accordingly, it is appreciated that the first embodiment of the carton of the invention prevents tampering with the contents of containers of consumer products between the packaging site and the ultimate point of sale. The invention protects the integrity of consumer product by sealing containers of consumer product at the packaging location, thus, if on arrival at the retail site it is found that the integrity of a carton seal has been breached, the contents of the carton will not be marketed. Further, to assure the integrity of the contents of the containers of consumer product after the containers have been placed on sale at the retail site, the carton is specially designed such that once containers of product are removed from the carton they cannot be replaced in the carton. Therefore, the contents of the containers cannot be removed from a carton, tampered with and replaced in the carton to be subsequently purchased by an unwary consumer. In sum, consumers personally removing containers of consumer product from cartons constructed in accordance with the first embodiment of the present invention are assured that the contents of that container have not been tampered with between the packaging site and the point of sale.

In a second preferred embodiment of the present invention, the invention allows for the cartons to be reloaded and reassembled at the retail location. Consequently, in the present embodiment, the cartons are not loaded with containers of consumer product, sealed and shipped exclusively at the point of manufacturing or distribution. The cartons can be refilled and reassembled at the retail location but can be reliably re-secured by locking closure means provided to secure the carton in a closed condition. As in the first embodiment, the carton is specially designed so that once containers of consumer product are removed from the carton they cannot be replaced in the carton. Thus, once the carton of the present embodiment has been loaded with containers and secured in a closed and locked condition, containers of consumer goods cannot be removed from the carton, tampered with and replaced to be purchased by an unwary consumer.

Figure 7:
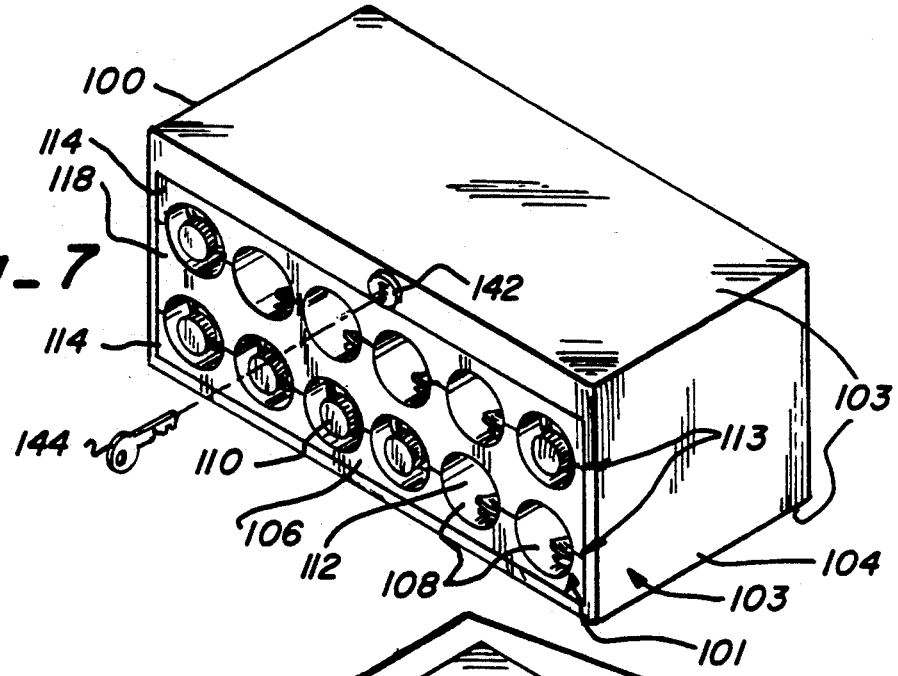
FIG. 7 is an isometric view of a second embodiment of the carton of the present invention.
Figure 8:
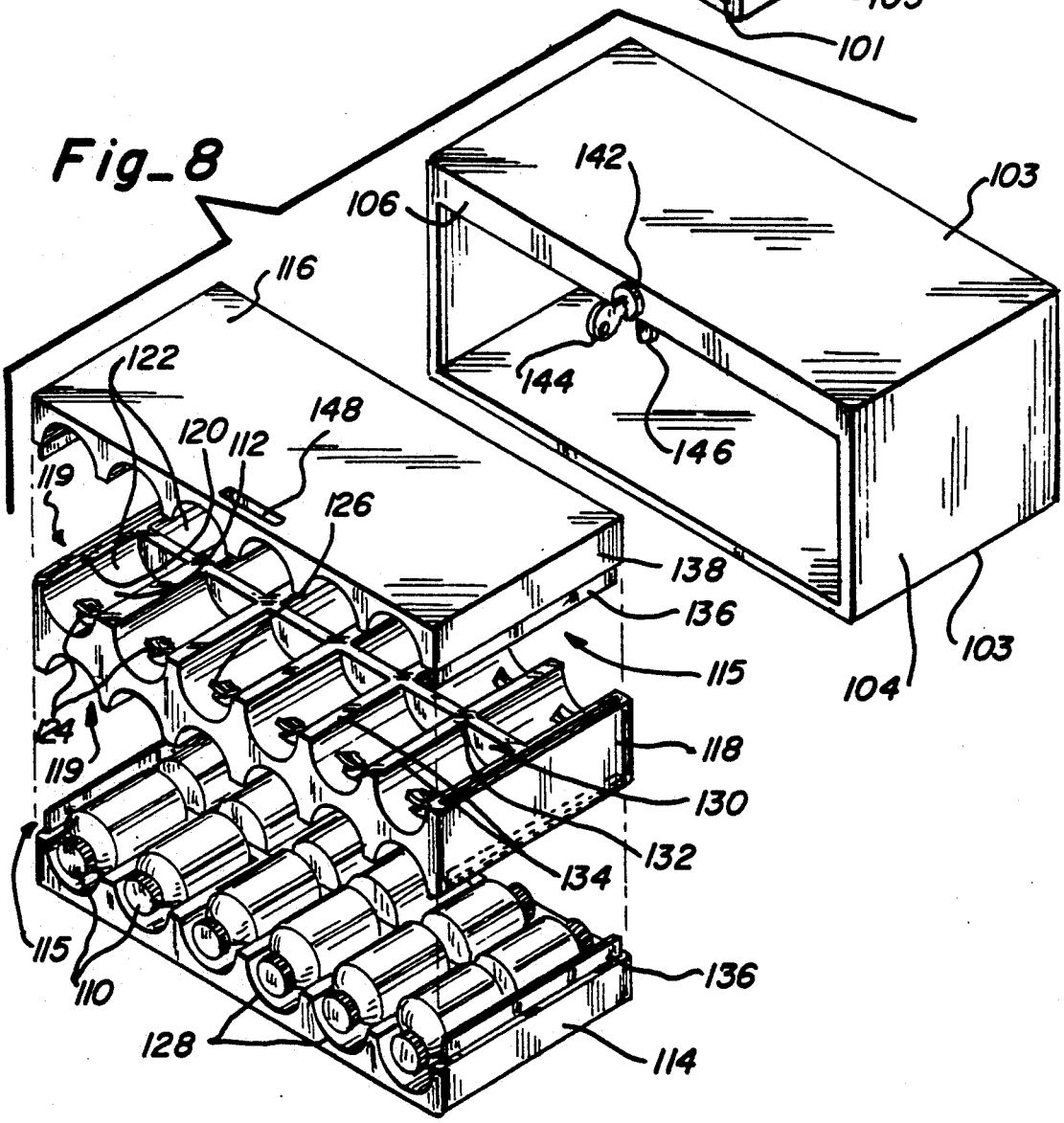
FIG. 8 is an exploded isometric view of the embodiment shown in FIG. 7.

The carton 100 of the second embodiment of the present invention has a multi-component inner body portion 101 and an outer locking shell or cabinet 102. Like the first embodiment, once assembled in a closed condition as shown in FIG. 7, the present embodiment of the carton has rectangular top and bottom surfaces 103, end surfaces 104 and front and back faces 106. The front and back faces present a number of openings 108 through which containers of consumer product 110 are dispensed from cylindrical compartments 112.

The inner, multi-component body portion 100 comprises a number of layers 113 formed by joining complementary sections Specifically, the multi-component body is formed by joining the uppermost and lowermost sections 114 with an intermediate section 118. The uppermost and lowermost sections 114 are substantially identical to sections 26 of the first described embodiment, each having a single confronting face 115 which will be further described below. The intermediate section 118 comprises dual opposed confronting faces 119 which are generally similar to the confronting faces of the uppermost and lowermost sections. End pieces 116 are fastened to the top and bottom walls of the uppermost and lowermost sections 114 of the carton to complete the uppermost and lowermost layers of the inner body portion of the carton.

In the confronting face 115 or faces 119 of the uppermost and lowermost sections 114 and intermediate section 118, respectively, two rows of equally-shaped, semi-cylindrical hollow recesses 122 are formed. Approximately centrally located in the inner walls of the hollow recesses 122 are dispensing control mechanisms in the form of flexible tongues or fingers 124 having a detached end 126 facing the open ends of the recesses 128, the tongues protruding into the semi-cylindrical hollow recesses. The tongues are formed in the sections 114 and 118 at the time the sections are fabricated. Further, in the confronting face is formed a transverse dividing wall 130 separating the semi-cylindrical recesses into halves. The exposed edge of the transverse dividing wall 132, as well as the exposed surfaces of the walls bounding the semi-cylindrical recesses 134, are flat, facilitating the joining of the sections in a confronting relationship.

To simplify assembly and reassembly at the retail location, tongues 136 are formed along the lateral ends of the uppermost and lowermost sections and grooves 138 adapted to receive the tongues are formed in confronting faces of the intermediate section 118. The interlocking of the tongues and grooves provides lateral support for the layers of the carton which simplifies final assembly as will be further appreciated later.

Once the layers are loaded with containers of consumer product 110 and partially assembled by alternately stacking lowermost, intermediate and uppermost sections of the carton, the inner body portion 101 is inserted into outer cabinet 103. The inner dimensions of the cabinet are closely fitted to the exterior dimensions of the inner body portion of the carton. The exposed opposite end surfaces 102 of the cabinet and the exposed upper and lower surfaces 104 of the cabinet are smooth to present a finished appearance. The end surfaces, as well as the upper and lower surfaces of the cabinet, may be decorated with product identification or other advertising information to enhance the appearance of the carton.

The cabinet 103 also features a locking mechanism 142. The locking mechanism has an opening (not seen) to receive a key 144 which can be used to rotate a locking bolt 146. A recess 148 is formed in the end pieces 116 which complete the uppermost section (and, for symmetry of manufacture, the lowermost section) which is receptive of the locking bolt. Once the loaded stack of sections is inserted into the cabinet, the locking bolt can be rotated to engage the recess in the uppermost section and the key is removed by authorized retail personnel to prevent unauthorized persons from rotating the locking bolt into an inoperative position. As a result, the stacked sections of the cabinet, once inserted into the carton, cannot be removed without a key. Further, the closely-fitted relationship between the exterior dimensions of the stacked layers and the interior dimensions of the cabinet prevents the sections from being separated while secured in the cabinet. Ultimately, after being fully assembled, the carton of the second embodiment is as securely sealed as the durably-assembled sections of the carton of the first embodiment.

The operation of the dispensing control mechanism effected by the flexible tongues or fingers 124 is the same as described in connection with the carton of the first embodiment.

Figure 9:
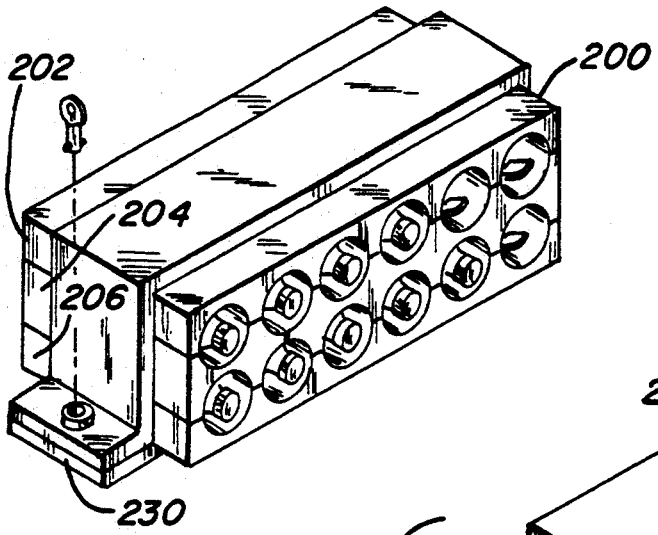
FIG. 9 is an isometric view of a still another embodiment of the carton of the present invention.
Figure 10:
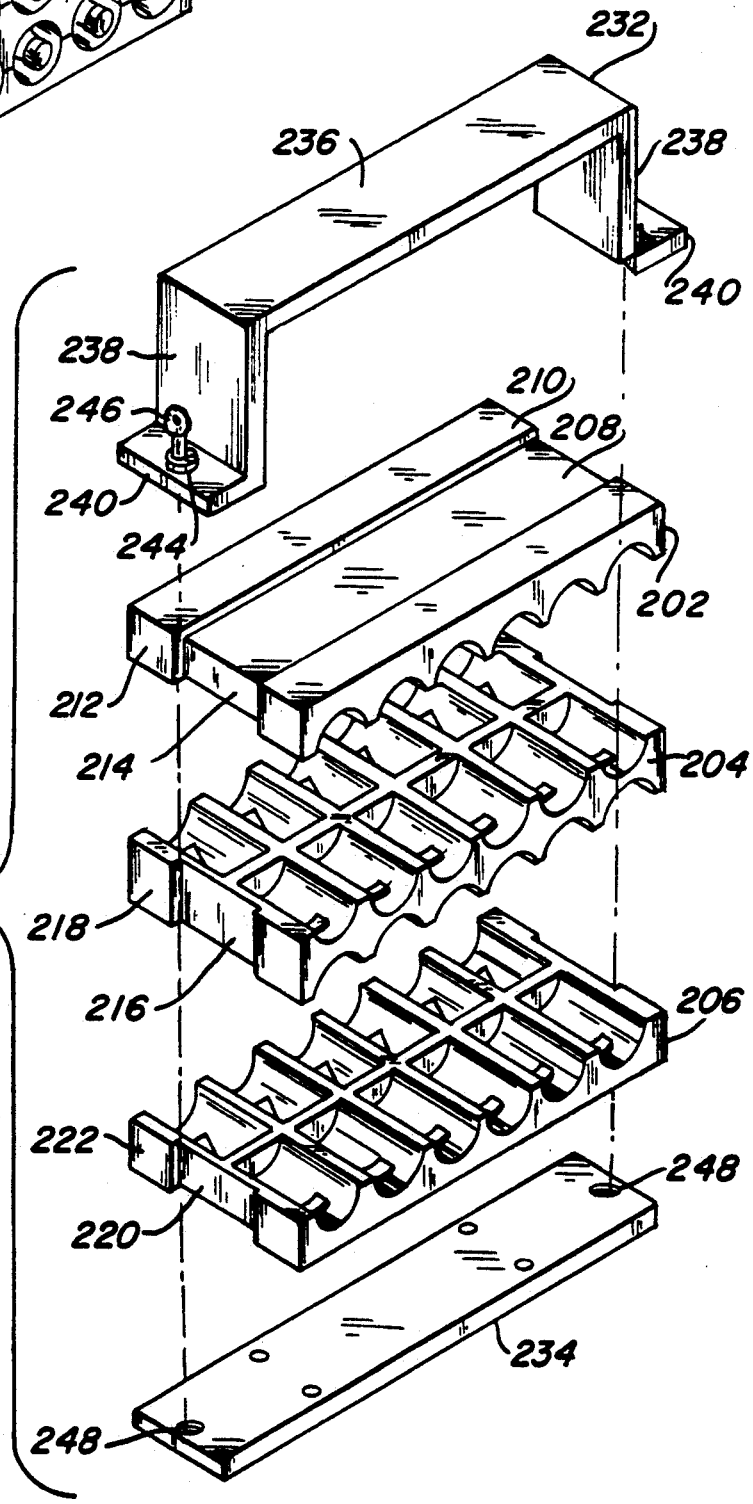
FIG. 10 is an exploded isometric view of the embodiment shown in FIG. 9.

A variation of the second embodiment of the present invention is depicted in FIGS. 9 and 10 as a third embodiment. The primary difference between the variations is that the sections of the carton in the third embodiment are secured by a retaining strap rather than being locked into a cabinet.

The third embodiment constitutes a carton 200 having a multi-component inner body portion 201 and an outer restraining strap 202. The inner body portion of this third embodiment of the carton 200 comprises an uppermost section 203, an intermediate section 204 and a lowermost section 206, which have formed in them exterior recesses. An upper recess 208 is formed in an upper surface 210 of the uppermost layer, as well as end recesses 212 in end surfaces 214 of the uppermost section. End recesses 216 are formed in the end surfaces 218 of the intermediate section. End recesses 220 are formed in the end surfaces of the lowermost section. These recesses all are of equal width and depth.

The recesses in the sections receive a retaining strap 230. The retaining strap has an upper segment 232 and a lower segment 234. The upper segment generally is comprised of three members, a cross member 236, lateral members 238 running perpendicular to the cross member and flange members 240. As shown in FIG. 9, the cross member of the upper segment of the retaining strap is received in the upper recess 208 in the uppermost surface 210 of the uppermost section 203. The lateral members of the upper segment engage the end recesses 212, 216 and 220 in the end surfaces 212, 218 and 222 of the uppermost section, the intermediate section 204 and the lowermost section 206, respectively. The cross member and lateral members of the upper segment are closely-fitted to the recesses formed in the sections of the carton so that the sections are securely bound by the retaining strap. The lower member generally engages a lower surface (not shown) of the lowermost section.

The upper segment 232 of the retaining strap 230 is secured to the lower segment 234 of the retaining strap by a pair of conventional, rotatable locking mechanisms 242 positioned at each end of the carton. In particular, a movable portion of each locking mechanism 244 is mounted in a flange member 240 of the upper segment. The movable portion of the locking mechanism has an opening (not seen) which is receptive of a key 246. The moveable portion of each locking mechanisms is rotatable only through the use of the key. Receptive of the movable portion of each locking mechanism is a non-movable portion 248 of the locking mechanism mounted in the lower segment 234 of the retaining strap. Once the sections of the carton are stacked and the retaining strap is locked in place over and around the stacked sections, the carton of this embodiment is sealed as securely as the durably-assembled sections of the carton of the first embodiment.

It should be noted that the retaining strap 230 of the variation could be implemented in other suitable ways. For example, rather than using a pair of locking mechanisms 244 mounted in the flange members 240 of both ends of the upper segment 232 of the retaining strap, one of the flange members of the upper segment could be hinged to an end of the lower segment 234. This hinge could be comprised of an ordinary hinge, fixably attached to both the upper and lower segments of the retaining strap. Alternatively, the hinge could be formed of a rotatable tongue and groove mechanism. The retaining strap need not be comprised of rigid members as the retaining strap could be comprised of a flexible but inelastic strip which could be similarly locked to a lower element to complete the carton. It should further be noted that the lower segment of the retaining strap could actually be attached to or be a part of a retail store shelf; consequently, the locking mechanism could serve not only to complete the assembly of the carton, but also to secure the carton to a retail shelf.

Accordingly, it is appreciated that the carton of either the second or third embodiment of the invention prevents tampering with the contents of containers of consumer products once the carton is loaded, assembled and displayed at a retail location. To assure the integrity of the contents of the containers of consumer product after the containers have been placed on sale at the retail site, the carton is specially designed such that once containers of product are removed from the carton they cannot be replaced in the carton. Therefore, the contents of the containers cannot be removed from a carton, tampered with and replaced in the carton to be subsequently purchased by an unwary consumer. In sum, consumers personally removing containers of consumer product from cartons described by the second or third embodiment of the present invention are assured that the contents of that container have not been tampered after the carton has been placed in the retail location.

Presently preferred embodiments of the present invention have been described with a degree of particularity. These descriptions have been made by way of preferred examples and are based on a present understanding of knowledge available regarding the invention. It should be understood, however, that the scope of the present invention is described by the following claims and not necessarily by the detailed descriptions of the preferred embodiments.

I claim:

1. A tamper-proof apparatus for distributing containers of consumer products comprising:

a carton having a plurality of compartments for receiving the containers of consumer products;

said carton being comprised of a plurality of carton sections which are securably joined to form the carton;

said sections having at least one surface with a plurality of recesses such that when said sections are joined face to face, said recesses define said compartments;

said compartments having openings through which the containers of consumer products may be removed; and, a dispensing control mechanism operatively associated with each compartment allowing said containers to be removed from the openings in the compartments while preventing containers from being inserted into the compartments.

2. The apparatus of claim 1 wherein the carton sections have complementary confronting surfaces such that a carton may be formed by joining the confronting surfaces of a plurality of carton sections.

3. The apparatus of claim 1 wherein the recesses are semi-cylindrical in shape such that when the sections are joined face to face the compartments formed by said recesses are cylindrical.

4. The apparatus of claim 1 wherein the carton sections are fabricated from plastic.

5. The apparatus of claim 1 wherein the carton sections are securably joined together with an adhesive.

6. The apparatus of claim 1 wherein the carton sections are securably joined together by fusing the carton segments together using heat.

7. The apparatus of claim 4 wherein the carton segments are securably joined together by sonic welds.

8. The apparatus of claim 1 wherein the carton sections are securably joined together by enclosing the sections within a releasably securable cabinet.

9. The apparatus of claim 1 wherein the carton sections are securably joined together by binding the sections with a releasably securable retaining strap.

10. The apparatus of claim 1 wherein the compartments are closely-fitted to the product containers.

11. The apparatus of claim 1 wherein the dispensing control apparatus comprises flexible tongues.

12. The apparatus of claim 1 wherein the flexible tongues have a detached end facing the openings of the compartments.

13. The apparatus of claim 12 wherein the detached end of the flexible tongue is positioned such that the containers of consumer product cannot be inserted into the compartments far enough for carton sections forming said compartments to support the weight of the container.

14. The apparatus of claim 1 further comprising a seal means enclosing the openings of the carton.

15. The apparatus of claim 14 wherein the seal means are fragile such that if the seal is breached it cannot be resealed without being visually detectable.

16. The apparatus of claim 14 wherein the seal means bear an indicia of authenticity such that if the seal were replaced with a different type of seal it would be discernible.

17. A tamper-proof method for distributing containers of consumer products comprising the steps of:

providing a plurality of carton sections;

forming a plurality of recesses in the sections;

forming the recesses wherein the recesses form a plurality of compartments when the sections are joined in a face to face relationship;

forming in each of the recesses an opening through which the containers of consumer products may be removed from the compartments when the sections are joined in a face to face relationship; and, providing each of the openings with a dispensing control mechanism allowing said containers to be removed from the compartments through the openings while preventing containers from being inserted into the compartments through the openings;

loading the containers of consumer product into the carton recesses; and assembling the carton by securably joining said sections in a face to face relationship.

18. The method of claim 17 further comprising the step of providing the dispensing control mechanism in the form of flexible tongues with a detached end facing the openings of the compartments.

19. The method of claim 18 further comprising the step of positioning the detached end of the flexible tongue such that the containers of consumer product cannot be inserted into the compartments through the openings far enough for the carton sections defining the compartments to support the weight of the container.

20. The method of claim 17 further comprising the step of sealing the openings in the carton.

21. The method of claim 20 further comprising the step of sealing the openings in the carton with seals which are not resealable.

22. The method of claim 20 further comprising the step sealing the openings in the carton with seals bearing an indicia of authenticity such that if the seals were replaced with a different seals it would be discernible.

* * * * *